US010566119B2

(12) United States Patent
Yang et al.

(10) Patent No.: US 10,566,119 B2
(45) Date of Patent: Feb. 18, 2020

(54) ORIENTED SILICON STEEL AND METHOD FOR MANUFACTURING SAME

(71) Applicant: BAOSHAN IRON & STEEL CO., LTD., Shanghai (CN)

(72) Inventors: Guohua Yang, Shanghai (CN); Xiandong Liu, Shanghai (CN); Guobao Li, Shanghai (CN); Yongjie Yang, Shanghai (CN); Zhuochao Hu, Shanghai (CN); Hongxu Hei, Shanghai (CN); Jun Zhang, Shanghai (CN); Dejun Su, Shanghai (CN); Huande Sun, Shanghai (CN); Meihong Wu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 14/646,985

(22) PCT Filed: Dec. 11, 2012

(86) PCT No.: PCT/CN2012/001684

§ 371 (c)(1),
(2) Date: May 22, 2015

(87) PCT Pub. No.: WO2014/078977

PCT Pub. Date: May 30, 2014

(65) Prior Publication Data

US 2015/0302962 A1 Oct. 22, 2015

(30) Foreign Application Priority Data

Nov. 26, 2012 (CN) ..... 2012 1 0485329

(51) Int. Cl.

| | |
|---|---|
| ***H01F 1/147*** | (2006.01) |
| ***C21D 8/12*** | (2006.01) |
| ***H01F 1/18*** | (2006.01) |
| ***C22C 38/02*** | (2006.01) |
| ***C22C 38/00*** | (2006.01) |
| ***C22C 38/06*** | (2006.01) |
| ***C22C 38/04*** | (2006.01) |
| ***C23C 8/80*** | (2006.01) |
| ***C21D 1/26*** | (2006.01) |
| ***C21D 3/04*** | (2006.01) |
| ***C21D 6/00*** | (2006.01) |
| ***C21D 9/46*** | (2006.01) |
| ***C23C 8/02*** | (2006.01) |
| ***C23C 8/26*** | (2006.01) |
| ***H01F 1/16*** | (2006.01) |
| ***H01F 41/02*** | (2006.01) |
| ***H01F 41/32*** | (2006.01) |

(52) U.S. Cl.

CPC ..... *H01F 1/14775* (2013.01); *C21D 1/26* (2013.01); *C21D 3/04* (2013.01); *C21D 6/008* (2013.01); *C21D 8/1216* (2013.01); *C21D 8/1222* (2013.01); *C21D 8/1233* (2013.01); *C21D 8/1255* (2013.01); *C21D 8/1261* (2013.01); *C21D 8/1283* (2013.01); *C21D 9/46* (2013.01); *C22C 38/001* (2013.01); *C22C 38/02* (2013.01); *C22C 38/04* (2013.01); *C22C 38/06* (2013.01); *C23C 8/02* (2013.01); *C23C 8/26* (2013.01); *C23C 8/80* (2013.01); *H01F 1/14783* (2013.01); *H01F 1/16* (2013.01); *H01F 1/18* (2013.01); *H01F 41/02* (2013.01); *H01F 41/32* (2013.01)

(58) Field of Classification Search

CPC .. C21D 8/1261; C21D 8/1255; C21D 8/1222; C21D 8/1233; C21D 8/1216; C21D 1/26; C21D 3/04; C21D 6/008; C21D 8/1215; C21D 8/1283; C21D 9/46; H01F 1/14775; H01F 1/14783; H01F 1/16; H01F 1/18; H01F 41/02; H01F 41/32; C22C 38/001; C22C 38/02; C22C 38/04; C22C 38/06; C23C 8/02; C23C 8/26; C23C 8/80

See application file for complete search history.

(56) References Cited

U.S. PATENT DOCUMENTS 5,858,126 A 1/1999 Takashima et al.

FOREIGN PATENT DOCUMENTS

CN 1796587 A 7/2007
CN 102618783 A 8/2012

(Continued)

OTHER PUBLICATIONS

Human translation of CN 102758127, 2012.*

(Continued)

*Primary Examiner* — Colleen P Dunn
*Assistant Examiner* — Anthony M Liang
(74) *Attorney, Agent, or Firm* — Eversheds Sutherland (US) LLP

(57) ABSTRACT

The invention discloses an oriented silicon steel with excellent magnetic properties and a manufacturing method thereof. The present invention obtains the oriented silicon steel with excellent magnetic properties by controlling the area ratio of small crystal grains of D<5 mm in an oriented silicon steel finished product to be not more than 3%, and controlling the ratio μ17/μ15 of the magnetic conductivity under the magnetic induction of 1.7 T and 1.5 T in the oriented silicon steel finished product to be 0.50 or more. In addition, by using a slab of the oriented silicon steel with suitable components and an optimized cold rolling step, the present invention effectively decreases the heating temperature of the slab and the production cost thereof, and simultaneously better controls the size and ratio of the crystal grains in the oriented silicon steel finished product and the magnetic conductivity in a certain range of magnetic induction, ensures that secondary recrystallization has good Goss texture orientation and finally, stably obtains the oriented silicon steel product with excellent magnetic properties.

3 Claims, No Drawings

(56) References Cited

FOREIGN PATENT DOCUMENTS

| | | | | | |
|---|---|---|---|---|---|
| CN | 102758127 | A | * | 10/2012 | |
| EP | 0339475 | B1 | | 7/1994 | |
| EP | 1992708 | A1 | * | 11/2008 | ..... C21D 8/12 |
| JP | 2008001977 | A | | 1/2008 | |

OTHER PUBLICATIONS

Machine-English translation of unexamined Korean publication No. 1020060032791, Apr. 18, 2006, Hong, Byung-Deug.*
English abstract of unexamined korean publication No. 2006032791, Apr. 18, 2006, Hong, Byung-Deug.*
International Search Report dated Dec. 11, 2012 for International Application No. PCT/CN2012/001684.

* cited by examiner

ORIENTED SILICON STEEL AND METHOD FOR MANUFACTURING SAME

CROSS-REFERENCE TO RELATED APPLICATIONS

This application claims priority to and benefit of PCT Application No. PCT/CN2012/001684, entitled "Oriented Silicon Steel And Method For Manufacturing Same," filed Dec. 11, 2012, which claims the benefit of Chinese Patent Application No. 201210485329.2 filed on Nov. 26, 2012, which are both incorporated herein by reference in their entirety.

FIELD OF THE INVENTION

The invention relates to an oriented silicon steel and a manufacturing method thereof, and particularly relates to an oriented silicon steel with excellent magnetic properties and a manufacturing method thereof.

BACKGROUND OF THE INVENTION

An oriented silicon steel has been widely applied to power transmission and transformation products such as large-scale transformers, and becomes one of indispensible raw materials in development of power industry. At present, people are committed to obtaining an oriented silicon steel with excellent magnetic properties. The main technical indexes of the magnetic properties in the oriented silicon steel comprise magnetic induction and iron loss, and the iron loss is directly related to the loss of an iron core when using power transmission and transformation products such as a transformer. It is said that the development history of silicon steel products is the history that the iron loss is continuously reduced actually. The magnetic induction, namely magnetic induction intensity, also known as magnetic flux density, reflects the magnetization intensity of a ferromagnetic material in a magnetic field, and the changes in the value of the magnetic induction per unit of magnetic field intensity is represented by magnetic conductivity. Under the using conditions of a user, the properties of the silicon steel product are closely related to the intensity of an external magnetic field, so that the magnetic conductivity, especially the magnetic conductivity in the vicinity of a working point of the transformer and other products, is more suitable for representing the magnetic properties under a certain magnetic field intensity. According to the investigation, in the related prior documents of the oriented silicon steel, the studies which are directly related to magnetic properties such as the magnetic conductivity are very few, and the studies regarding the influence of the structure of the oriented silicon steel material on key properties such as the magnetic conductivity are even fewer.

Japanese Patent JP 60-59045A and Chinese Patent CN 91103357 respectively disclose that, by adopting a cold rolling aging rolling method, the number of small crystal grains with grain equivalent circle diameter D of not more than 2 mm in an oriented silicon steel finished product can be increased, so that the iron loss of the oriented silicon steel finished product can be reduced. But in the above patent literatures, only on the premise that the secondary recrystallization of the oriented silicon steel finished product is perfect, appropriately increasing the number of the small crystal grains contributes to decrease the iron loss. And, the small crystal grains herein should be specifically understood to be small-size grains with relatively small deviation angles with the direction of a Goss texture, namely (110)[001] direction, otherwise, the effect of improving the magnetic properties is difficult to achieve. Thus, the way of only increasing the number of the small crystal grains in the oriented silicon steel finished product should not become the standard of judging whether the magnetic properties of the oriented silicon steel are improved, this is because that the grain orientation of the small-size grains is highly possible to be subjected to large-angle deviation from the direction of the Goss texture, the possibility is far higher than that of large-size grains, and the appearance of a large number of small crystal grains having a large-angle deviation from the Goss texture will seriously degrade the magnetic properties of the oriented silicon steel finished product. On the contrary, the average deviation angle between the orientation of the large crystal grains with the grain equivalent circle diameter D of not less than 5 mm and the Goss texture generally is within 7°. Thus, under general circumstances, by increasing the number or the area ratio of the large crystal grains in the oriented silicon steel finished product or controlling the number or the area ratio of the small crystal grains to be within a certain range, it can be better ensured that the oriented silicon steel has good magnetic properties and the stability in the magnetic properties.

In U.S. Pat. No. 7,887,645B1, it is mentioned that by controlling the ratio of an Austenite phase in an oriented silicon steel hot rolled plate, the normalization cooling rate is increased, and the magnetic conductivity can be improved. But in this patent, the 'magnetic conductivity' specifically refers to the magnetic induction under the magnetic field intensity of 796 A/m and is not the magnetic conductivity defined in general physical meaning. Furthermore, a large amount of Cr is added in a slab of the patent, thereby being adverse to environmental friendliness and being also adverse to stably obtaining the oriented silicon steel product with high magnetic properties. In addition, in the patent, it is recommended to heat the slab at the high temperature of about 1400° C., so that a special heating furnace needs to be configured, and the energy consumption is relatively high; and furthermore, molten slag appears on the surface of the steel slab, the heating equipment needs to be cleaned regularly, the yield is affected, the finished product rate is reduced, the maintenance cost of the equipment is high, and thus the patent is not suitable for popularization.

In U.S. Pat. No. 5,718,775A, it is mentioned that the magnetic conductivity of the oriented silicon steel finished product under the magnetic induction of 1.0 T needs to be controlled to be not lower than 0.03 H/m. However, according to the actual technical magnetization hysteresis loop analysis, under the relatively low magnetic field, when the magnetic induction is relatively low, domain walls of magnetic domains move; and with the increase of the magnetic field intensity, the magnetic induction is increased, and when the magnetic induction is about 1.5-1.9 T, the magnetic domains which have grown due to the movement of the domain walls and the magnetic domains which have not been swallowed up occur irreversible rotation so as to enable magnetization vectors to be parallel to the direction of the magnetic field gradually. The process is continued till the magnetization vectors of all the magnetic domains are rotated to be parallel to the direction of the magnetic field, and at this time, a saturated magnetic induction value Bs of the material is achieved. Working points used in products such as the transformer are generally designed to be within the magnetic induction range of 1.5-1.7 T, so that the control requirements for the magnetic conductivity of the oriented silicon steel under the magnetic induction of 1.0 T in U.S. Pat. No. 5,718,775A do not have practical significance.

Although some development have been made in the aspects of improving the magnetic conductivity and the iron loss of the oriented silicon steel in the prior art, there is still large room in the aspects of improving the magnetic properties of the oriented silicon steel under the working magnetic flux density of 1.5-1.7 T. People hopes to develop the oriented silicon steel with excellent magnetic properties under the working magnetic flux density of 1.5-1.7 T to satisfy the requirements of electronic equipments such as the transformer. In addition, the conventional manufacturing method of the oriented silicon steel still has the relatively large improvement room, and the research and development of the manufacturing method capable of obtaining the oriented silicon steel with excellent magnetic properties also has important significance and broad application prospects.

SUMMARY OF THE INVENTION

The invention aims to provide an oriented silicon steel with excellent magnetic properties and a manufacturing method thereof. The inventor finds that, when the area ratio of small crystal grains with the grain size of less than 5 mm (referred to as D<5 mm hereinafter) in an oriented silicon steel finished product is not more than 3%, preferably not more than 2% and the ratio μ17/μ15 of the magnetic conductivity under the magnetic induction of 1.7 T to the magnetic conductivity under the magnetic induction of 1.5 T in the oriented silicon steel finished product is 0.50 or more, preferably 0.55 or more, the oriented silicon steel finished product with excellent magnetic properties can be obtained. Furthermore, the inventor finds that, by adopting a slab of the oriented silicon steel with suitable components and an optimized cold rolling step to control the area ratio of the small crystal grains with D<5 mm in the oriented silicon steel finished product to be not more than 3% and control the magnetic conductivity ratio μ17/μ15 to be 0.50 or more, the oriented silicon steel product with excellent magnetic properties can be stably obtained.

The invention relates to an oriented silicon steel with excellent magnetic properties, wherein the area ratio of small crystal grains with D<5 mm in the oriented silicon steel is not more than 3%, preferably not more than 2%; and the ratio μ17/μ15 of the magnetic conductivity under the magnetic induction of 1.7 T, to the magnetic conductivity under the magnetic induction of 1.5 T in the oriented silicon steel finished product is 0.50 or more, preferably 0.55 or more.

The appearance of a large number of small crystal grains deviating from a Goss texture in the oriented silicon steel finished product can seriously degrade the magnetic properties of the oriented silicon steel finished product, but the average deviation angle between the orientation of large crystal grains with the grain size (equivalent circle diameter) D≥5 mm and the Goss texture in the oriented silicon steel finished product generally is within 7°, and thus, by controlling the area ratio of the small crystal grains with D<5 mm to be within a certain range, namely increasing the area ratio of the large-size grains in the oriented silicon steel finished product, it can be better ensured that the oriented silicon steel has good magnetic properties and the stability in the magnetic properties. The inventor finds that, by controlling the ratio of the area of small crystal grains with D<5 mm in the oriented silicon steel finished product to the total area to be within 3%, the excellent rate of the magnetic properties of the oriented silicon steel finished product and the qualification rate of a whole roll can be greatly improved. Furthermore, the inventor finds that, when the ratio of μ17/μ15 of the magnetic conductivity μ17 under the magnetic induction of 1.7 T to the magnetic conductivity μ15 under the magnetic induction of 1.5 T in the oriented silicon steel finished product is 0.50 or more, it is sufficiently ensured that the oriented silicon steel product with excellent magnetic properties of high magnetic induction and low iron loss can be stably obtained.

The invention further relates to a manufacturing method of the oriented silicon steel, comprising the following steps in sequence:

heating a slab of the oriented silicon steel to 1100-1200° C. and then performing hot rolling to obtain a hot rolled plate;

performing cold rolling on the hot rolled plate at the cold rolling reduction ratio of 85% or more to obtain a cold rolled plate with the thickness of an oriented silicon steel finished product;

performing an annealing treatment on the cold rolled plate to obtain the oriented silicon steel finished product; wherein, the slab of the oriented silicon steel comprises the following components by weight percentage: 2.5-4.0% of Si, 0.010-0.040% of acid-soluble aluminum Als, 0.004-0.012% of N and 0.015% or less of S; and the area ratio of the small crystal grains with the grain size of less than 5 mm in the oriented silicon steel finished product is not more than 3%, and the ratio μ17/μ15 of the magnetic conductivity under the magnetic induction of 1.7 T to the magnetic conductivity under the magnetic induction of 1.5 T in the oriented silicon steel finished product is 0.50 or more.

According to the invention, by controlling the Si content and the contents of inhibitor composition elements, such as the contents of Als, N and S in the components of the slab of the oriented silicon steel, it can be ensured that sufficient nitride inhibitors are contained in a steel plate during the production to obtain the perfect secondary recrystallization and improve the orientation degree of secondary recrystallized grains in the direction of the Goss texture, namely (110)[001] direction. Furthermore, in the case of using the slab of the oriented silicon steel of the invention, MN is used as a main inhibitor, and the production of inhibitors having high solid solution temperature such as sulfides is inhibited. The solid solution temperature of AlN is about 1280° C. and slightly changes with the fluctuations in concentration of Al or N in the slab, but the solid solution temperature is significantly lower than the solid solution temperature of a system adopting MnS or MnSe as the main inhibitor (see U.S. Pat. No. 5,711,825); and furthermore, the invention adopts the method for realizing partial solid solution of the inhibitors so as to effectively reduce the heating temperature of the slab to 1200° C. or less. The so-called partial solid solution of the inhibitors is relative to complete solid solution of the inhibitors. The method for realizing the complete solid solution of the inhibitors is as follows: in-steel micro precipitates called as the inhibitors achieve a complete solid solution state when the slab is heated before hot rolling and then are precipitated in an annealing process step during and after hot rolling, and the precipitation state is further adjusted. There is a problem in this method, that is, in order to realize complete solid solution of the precipitates, it is required to heat at high temperature of 1350° C. or more, the temperature is about 200° C. higher than the heating temperature for slabs of general steel grades, and a special heating furnace is required; and furthermore, the problem of more molten iron oxide scale, namely molten slag exists.

However, by adopting the method for realizing the partial solid solution of the inhibitors, the heating temperature of the slab is lower than the temperature for realizing the complete solid solution of the inhibitors, when the slab is heated, the inhibitors in the steel only achieve the partial solid solution, and although the strength of the inhibitors obtained after hot rolling is reduced, the nitride inhibitors can be supplemented by nitriding treatment in the subsequent process step to satisfy the requirements of secondary recrystallization. Thus, by adopting the method of the invention, there is no need for a special silicon steel heating furnace, and a conventional carbon steel heating furnace can be adopted to realize cross hot rolling production together with other steel grades such as carbon steel and the like; and furthermore, compared with the production of general oriented silicon steel, production equipment and control equipment such as apparatuses and instruments have no changes, and thus the production control and operation are simple and convenient, production and operation staff do not need to be additionally trained, and the production cost is reduced.

The contents and the basic effects of Si and the various inhibitors in the slab of the oriented silicon steel are described as follows:

Si: 2.5-4.0%. The eddy current loss of the oriented silicon steel is reduced with the increase of Si content, and if the Si content is lower than 2.5%, the effect of reducing the eddy current loss cannot be achieved; and if the Si content is higher than 4.0%, cold rolling batch production cannot be performed due to the increase of brittleness.

Acid-soluble aluminum Als: 0.010-0.040%. As the main inhibitor component of the oriented silicon steel with high magnetic induction, if the content of acid-soluble aluminum Als is lower than 0.010%, sufficient AlN cannot be obtained, the inhibition strength is not enough, and the secondary recrystallization does not occur; and if the content of Als is higher than 0.040%, the size of the inhibitor is coarsened, and the inhibition effect is reduced.

N: 0.004-0.012%. The effects are similar to the effects of acid-soluble aluminum, N is also used as the main inhibitor component of the oriented silicon steel with high magnetic induction, and if the N content is lower than 0.004%, sufficient AlN cannot be obtained, and the inhibition strength is not enough; and if the N content is higher than 0.012%, the defects in a bottom layer are increased.

S: 0.015% or less. If the S content is higher than 0.015%, segregation and precipitation are prone to occurring, so that the secondary recrystallization defects are increased.

In addition, the invention adopts a cold rolling method with great reduction ratio (the cold rolling reduction ratio of 85% or more), which contributes to improve the dislocation density of the cold rolled plate, forming more Goss crystal nuclei during primary recrystallization, providing more favorable textures, and contributes to perform full secondary recrystallization and improve the orientation degree of secondary recrystallization grains, and finally significantly improve the magnetic properties of the oriented silicon steel product. The cold rolling reduction ratio herein refers to the ratio of the reduction amount in cold rolling to the thickness before reduction.

According to the manufacturing method of the oriented silicon steel in the invention, cold rolling can be directly performed after hot rolling without annealing treatment of the hot rolled plate, which can further decrease the production cost of the oriented silicon steel, and thus has high potential benefits.

In the aspect of further improving the magnetic properties of the oriented silicon steel finished product, preferably, before cold rolling, the annealing treatment for hot rolled plate is performed on the hot rolled plate, wherein the annealing temperature of the annealing treatment for hot rolled plate preferably is 900-1150° C. and the annealing cooling rate preferably is 20° C./s-100° C./s, if the cooling rate is more than 100° C./s, as the structure homogeneity in the steel after rapid cooling becomes poor, the effect of improving the magnetic properties of the final product is reduced; and furthermore, if the cooling rate more than 100° C./s is adopted for production, the plate shape of a steel plate is poor, and the subsequent production is very difficult to perform. By performing the annealing treatment for hot rolled plate on the hot rolled plate, the number of the Goss crystal nuclei during primary recrystallization and the strength of the favorable textures can be further increased, which contributes to the perfection of the secondary recrystallization, and improve the magnetic properties of the oriented silicon steel finished product.

The annealing treatment in the manufacturing method of the oriented silicon steel of the invention can be performed by common methods used in a traditional technology, for example, decarbonization annealing, coating an annealing separator, high-temperature annealing, applying an insulating coating and hot stretching leveling annealing are sequentially performed on the cold rolled plate, wherein the annealing separator is used for preventing mutual bonding of steel plates at high temperature, and raw materials can use MgO and the like as main components; and the insulating coating is used for improving the insulation and the like of the surface of the silicon steel, and the raw materials which are mainly based on chromic anhydride, colloidal $SiO_2$ and phosphates of Mg and Al are widely adopted at present.

In the aspect of further improving the magnetic properties of the oriented silicon steel finished product, preferably, the manufacturing method of the oriented silicon steel of the invention further comprises nitriding treatment of the cold rolled plate before high-temperature annealing. According to the invention, the supplemented nitride inhibitors are obtained by nitriding treatment, so that the concentration of the inhibitors can be enhanced, and it can be ensured that there is MN with sufficient strength in the late stage of the production process to complete the effect of inhibiting the growth of the grains in other azimuth directions, thereby being conductive to improving the orientation degree of secondary recrystallization grains in the direction of the Goss texture and significantly improving the magnetic properties of the oriented silicon steel finished product.

According to the invention, by adopting the slab of the oriented silicon steel with suitable components and the optimized cold rolling step to control the area ratio of the small grains with D<5 mm in the oriented silicon steel finished product to be not more than 3% and control the magnetic conductivity ratio $\mu17/\mu15$ to be 0.50 or more, the oriented silicon steel product with excellent magnetic properties can be stably obtained.

The invention obtains the oriented silicon steel with excellent magnetic properties by controlling the area ratio of the small grains with D<5 mm in the oriented silicon steel finished product to be not more than 3%, and controlling the ratio $\mu17/\mu15$ of the magnetic conductivity under the magnetic induction of 1.7 T to the magnetic conductivity under the magnetic induction of 1.5 T in the oriented silicon steel finished product to be 0.50 or more. In addition, by using the slab of the oriented silicon steel with suitable components and the optimized cold rolling step, the invention effectively reduces the heating temperature of the slab and the production cost, and simultaneously better controls the size and ratio of the grains in the oriented silicon steel finished product and the magnetic conductivity in a certain range of magnetic induction, ensures that secondary recrystallization has good Goss texture orientation and finally stably obtains the oriented silicon steel product with excellent magnetic properties.

DETAILED DESCRIPTION OF THE EMBODIMENTS

The invention is described in more detail below in conjunction with the examples, but the protection scope of the invention is not limited to these examples.

EXAMPLES 1-8 AND COMPARATIVE EXAMPLES 1-5

A slab of an oriented silicon steel comprises the following components by weight percentage: 0.050% of C, 3.0% of Si, 0.030% of Als, 0.007% of N, 0.008% of S, 0.14% of Mn and the balance of Fe and inevitable impurities. The slab is heated in a heating furnace at the temperature of 1000-1250° C. and then hot-rolled to obtain a hot rolled plate with the thickness of 2.5 mm, cold rolling is performed on the hot rolled plate at different cold rolling reduction ratios to obtain the finished product thickness of 0.30 mm, then decarbonization annealing is performed, an annealing separator taking magnesium oxide as a main component is coated, and high-temperature annealing is performed after coiling; nitriding treatment is performed after final cold rolling and before high-temperature annealing and secondary recrystallization; and applying an insulating coating and stretching leveling annealing are performed after uncoiling to obtain an oriented silicon steel finished product. The relationship between the area ratio of small grains with D<5 mm and the magnetic conductivity ratio μ17/μ15 in the oriented silicon steel finished product and the magnetic properties of the oriented silicon steel finished product is studied, and the results are as shown in Table 1.

TABLE 1

Influences of area ratio of small grains with D <5 mm and magnetic conductivity ratio μ17/μ15 in oriented silicon steel finished product on magnetic properties of oriented silicon steel finished product

| | Area ratio of small grains with D <5 mm (%) | μ17/μ15 | Magnetic induction B8 (T) | Iron loss P17/50, (W/kg) |
|---|---|---|---|---|
| Example 1 | 0.5 | 0.55 | 1.91 | 0.96 |
| Example 2 | 1 | 0.56 | 1.92 | 0.95 |
| Example 3 | 2 | 0.55 | 1.92 | 0.96 |
| Example 4 | 2 | 0.54 | 1.91 | 0.98 |
| Example 5 | 2 | 0.51 | 1.89 | 1.01 |
| Example 6 | 3 | 0.54 | 1.90 | 0.99 |
| Example 7 | 3 | 0.52 | 1.89 | 1.02 |
| Example 8 | 3 | 0.50 | 1.88 | 1.03 |
| Comparative example 1 | 3 | 0.49 | 1.87 | 1.07 |
| Comparative example 2 | 3 | 0.43 | 1.85 | 1.16 |
| Comparative example 3 | 4 | 0.50 | 1.86 | 1.08 |
| Comparative example 4 | 5 | 0.51 | 1.84 | 1.15 |
| Comparative example 5 | 10 | 0.52 | 1.79 | 1.24 |

It can be known from Table 1 that, compared with the comparative examples 1-5 in which the area ratio of the small grains with D<5 mm is more than 3% or the magnetic conductivity ratio μ17/μ15 is less than 0.50, the examples 1-8 in which the area ratio of the small grains with D<5 mm in the oriented silicon steel finished product is not more than 3% and the ratio μ17/μ15 of the magnetic conductivity under the magnetic induction of 1.7 T to the magnetic conductivity under the magnetic induction of 1.5 T is not less than 0.50 have higher magnetic induction and lower iron loss. Furthermore, it can be known from Table 1 that, compared with the example 6, the magnetic properties of the oriented silicon steel finished product in the example 4 in which the area ratio of the small grains with D<5 mm is 2% or less are further improved; and compared with the example 4, the magnetic properties of the oriented silicon steel finished product in the example 3 in which the magnetic conductivity ratio μ17/μ15 is 0.55 are further improved.

EXAMPLE 9-15 AND COMPARATIVE EXAMPLES 6-14

A slab of an oriented silicon steel comprises the following components by weight percentage: 0.075% of C, 3.3% of Si, 0.031% of Als, 0.009% of N, 0.012% of S, 0.08% of Mn and the balance of Fe and inevitable impurities. The slab is heated in a heating furnace at five different heating temperatures in the range of 1050-1250° C. and then hot-rolled to obtain a hot rolled plate with the thickness of 2.3 mm, cold rolling is performed on the hot rolled plate at different cold rolling reduction ratios to obtain different specification finished product thicknesses in the range of 0.20-0.40 mm, then decarbonization annealing is performed, an annealing separator taking magnesium oxide as a main component is coated, and high-temperature annealing is performed after coiling; nitriding treatment is performed after final cold rolling and before high-temperature annealing and secondary recrystallization; and applying an insulating coating and stretching leveling annealing are performed after uncoiling to obtain an oriented silicon steel finished product. The relationship among the heating temperature of the slab and the cold rolling reduction ratio and the area ratio of small grains with D<5 mm and the magnetic conductivity ratio μ17/μ15 is studied, and the results are as shown in Table 2.

TABLE 2

Influences of heating temperature of slab and cold rolling reduction ratio on area ratio of small grains with D <5 mm and magnetic conductivity ratio μ17/μ15 in oriented silicon steel finished product

| | Heating temperature of slab (° C.) | Cold rolling reduction ratio (%) | Area ratio of small grains with D <5 mm (%) | μ17/μ15 |
|---|---|---|---|---|
| Example 9 | 1100 | 85 | 0.5 | 0.50 |
| Example 10 | 1100 | 88 | 1 | 0.55 |
| Example 11 | 1150 | 85 | 1 | 0.52 |
| Example 12 | 1150 | 88 | 2 | 0.54 |
| Example 13 | 1150 | 91 | 3 | 0.55 |
| Example 14 | 1200 | 85 | 2 | 0.51 |
| Example 15 | 1200 | 88 | 3 | 0.52 |
| Comparative example 6 | 1050 | 83 | 29 | 0.33 |
| Comparative example 7 | 1050 | 85 | 27 | 0.32 |

TABLE 2-continued

Influences of heating temperature of slab and cold rolling reduction ratio on area ratio of small grains with D <5 mm and magnetic conductivity ratio μ17/μ15 in oriented silicon steel finished product

| | Heating temperature of slab (° C.) | Cold rolling reduction ratio (%) | Area ratio of small grains with D <5 mm (%) | μ17/μ15 |
|---|---|---|---|---|
| Comparative example 8 | 1050 | 88 | 31 | 0.33 |
| Comparative example 9 | 1100 | 83 | 7 | 0.42 |
| Comparative example 10 | 1150 | 83 | 5 | 0.46 |
| Comparative example 11 | 1200 | 83 | 6 | 0.50 |
| Comparative example 12 | 1250 | 83 | 12 | 0.41 |
| Comparative example 13 | 1250 | 85 | 15 | 0.44 |
| Comparative example 14 | 1250 | 88 | 17 | 0.45 |

It can be known from Table 2 that, in the case that the slab of the oriented silicon steel in the invention is adopted, the slab is heated in the temperature range of 1100-1200° C., then hot rolling is performed, and the cold rolling reduction ratio of 85% or more is adopted, and thus it can be ensured that in the oriented silicon steel finished product, the area ratio of the small grains with D<5 mm is not more than 3%, the ratio μ17/μ15 of the magnetic conductivity under the magnetic induction of 1.7 T to the magnetic conductivity under the magnetic induction of 1.5 T is 0.50 or more, and thus it is ensured that the oriented silicon steel finished product with excellent magnetic properties can be obtained.

EXAMPLES 16-31

A slab of an oriented silicon steel comprises the following components by weight percentage: 0.065% of C, 3.2% of Si, 0.025% of Als, 0.010% of N, 0.015% of S, 0.18% of Mn and the balance of Fe and inevitable impurities. The slab is heated in a heating furnace at the temperature of 1150° C. and then hot-rolled to obtain a hot rolled plate with the thickness of 3.0 mm, (A) direct cold rolling is performed on the hot rolled plate or (B) annealing is performed on the hot rolled plate at the temperature of 850-1200° C. and the cooling rate of 15-25° C./s, then cold rolling is performed at the cold rolling reduction ratio of 85%, the rolling is performed until the finished product thickness of 0.30 mm is obtained, then decarbonization annealing is performed, an annealing separator taking magnesium oxide as a main component is coated, and high-temperature annealing is performed after coiling; nitriding treatment is performed after final cold rolling and before high-temperature annealing and secondary recrystallization; and applying an insulating coating and stretching leveling annealing are performed after uncoiling to obtain an oriented silicon steel finished product. The relationship among the annealing conditions of the hot rolled plate and the area ratio of small grains with D<5 mm and the magnetic conductivity ratio μ17/μ15 in the oriented silicon steel finished product is studied, and the results are as shown in Table 3.

TABLE 3

Influences of annealing conditions of hot rolled plate on area ratio of small grains with D <5 mm and magnetic conductivity ratio μ17/μ15 in oriented silicon steel finished product

| | Whether to perform annealing of hot rolled plate | Annealing temperature of hot rolled plate (° C.) | Annealing cooling rate of hot rolled plate (° C./s) | Area ratio of small grains with D <5 mm (%) | μ17/μ15 |
|---|---|---|---|---|---|
| Example 16 | A | | | 3 | 0.53 |
| Example 17 | B | 850 | 15 | 2 | 0.53 |
| Example 18 | B | 850 | 20 | 2 | 0.53 |
| Example 19 | B | 850 | 25 | 3 | 0.54 |
| Example 20 | B | 900 | 15 | 2 | 0.53 |
| Example 21 | B | 900 | 20 | 2 | 0.57 |
| Example 22 | B | 900 | 25 | 3 | 0.58 |
| Example 23 | B | 1000 | 15 | 2 | 0.54 |
| Example 24 | B | 1000 | 20 | 3 | 0.58 |
| Example 25 | B | 1000 | 25 | 3 | 0.60 |
| Example 26 | B | 1150 | 15 | 2 | 0.54 |
| Example 27 | B | 1150 | 20 | 3 | 0.59 |
| Example 28 | B | 1150 | 25 | 3 | 0.62 |
| Example 29 | B | 1200 | 15 | 3 | 0.53 |
| Example 30 | B | 1200 | 20 | 3 | 0.54 |
| Example 31 | B | 1200 | 25 | 3 | 0.54 |

It can be known from Table 3 that, compared with the example 16 in which annealing of the hot rolled plate is not adopted, in the examples 17-31 in which annealing of the hot rolled plate is adopted, the area ratio of the small grains with D<5 mm in the oriented silicon steel finished product is reduced or the magnetic conductivity ratio μ17/μ15 is increased, and thus the magnetic properties of the oriented silicon steel finished product are improved. Furthermore, it can be known from Table 3 that, performing the annealing at the temperature of 900-1150° C. and the cooling rate of 20° C./s or more on the hot rolled plate can ensure that the magnetic conductivity ratio μ17/μ15 is 0.55 or more and thus further stably improve the magnetic properties of the oriented silicon steel finished product.

Experimental results of the invention prove that, when the area ratio of the small grains with D<5 mm in the oriented silicon steel finished product is not more than 3% and the ratio μ17/μ15 of the magnetic conductivity under the magnetic induction 1.7 T to the magnetic conductivity under the magnetic induction of 1.5 T in the oriented silicon steel finished product is 0.50 or more, the oriented silicon steel finished product with excellent magnetic properties can be obtained. According to the invention, by adopting the slab of the oriented silicon steel with suitable components and an optimized cold rolling step to control the area ratio of the small grains with D<5 mm in the oriented silicon steel finished product to be not more than 3% and control the magnetic conductivity ratio μ17/μ15 to be 0.50 or more, the oriented silicon steel product with excellent magnetic properties can be stably obtained.

The invention obtains the oriented silicon steel with excellent magnetic properties by controlling the area ratio of the small grains with D<5 mm in the oriented silicon steel finished product to be not more than 3%, and controlling the ratio μ17/μ15 of the magnetic conductivity under the magnetic induction of 1.7 T to the magnetic conductivity under the magnetic induction of 1.5 T in the oriented silicon steel finished product to be 0.50 or more. In addition, by using the slab of the oriented silicon steel with suitable components and the optimized cold rolling step, the invention effectively reduces the heating temperature of the slab and the production cost, and simultaneously better controls the size and ratio of the grains in the oriented silicon steel finished product and the magnetic conductivity in a certain range of magnetic induction, ensures that secondary recrystallization has good Goss texture orientation and finally stably obtains the oriented silicon steel product with excellent magnetic properties.

The invention claimed is:

1. A manufacturing method of an oriented silicon steel, comprising the following steps in sequence:

heating a slab of the oriented silicon steel to 1100-1200° C. and then performing a hot rolling to obtain a hot rolled plate;

performing, directly after hot rolling without an annealing treatment of the hot rolled plate, a cold rolling on the hot rolled plate at a cold rolling reduction ratio of 85% or more, so as to obtain a cold rolled plate having a thickness of a finished product of the oriented silicon steel;

performing an annealing treatment on the cold rolled plate to obtain the finished product of the oriented silicon steel, wherein the annealing treatment comprises the following in sequence: decarbonization annealing, coating an annealing separator, high-temperature annealing, applying an insulating coating, and hot-stretching leveling annealing; and the manufacturing method further comprises: before the high-temperature annealing, performing a nitriding treatment on the cold rolled plate; wherein, the slab of the oriented silicon steel comprises the following components by weight percentage: 2.5-4.0% of Si, 0.010-0.040% of acid-soluble aluminum Al, 0.004-0.012% of N, and 0.015% or less of S; and an area ratio of small crystal grains having a grain size of less than 5 mm in the finished product of the oriented silicon steel is not more than 3%, and a ratio μ17/μ15 of a magnetic conductivity under magnetic induction of 1.7 T and 1.5 T in the finished product of the oriented silicon steel is 0.50 or more, wherein Goss texture in the finished product is within 7 degrees.

2. The manufacturing method of the oriented silicon steel according to claim 1, wherein the area ratio of small crystal grains having a grain size of less than 5 mm in the finished product of the oriented silicon steel is not more than 2%.

3. The manufacturing method of the oriented silicon steel according to claim 1, wherein the ratio μ17/μ15 of the magnetic conductivity under magnetic induction of 1.7 T and 1.5 T in the finished product of the oriented silicon steel is 0.55 or more.

* * * * *